US008069588B2

(12) United States Patent
Rivas et al.

(10) Patent No.: US 8,069,588 B2
(45) Date of Patent: Dec. 6, 2011

(54) ADJUSTABLE SLIDING EYELET FOR FOOTWEAR

(75) Inventors: Jake Rivas, Oakland, CA (US); Barry McGeough, Santa Barbara, CA (US); Gregory McNamara, Oakland, CA (US)

(73) Assignee: The North Face Apparel Corporation, Wilmington, DE (US)

( * ) Notice: Subject to any disclaimer, the term of this patent is extended or adjusted under 35 U.S.C. 154(b) by 577 days.

(21) Appl. No.: 12/275,171

(22) Filed: Nov. 20, 2008

(65) Prior Publication Data

US 2009/0126227 A1 May 21, 2009

Related U.S. Application Data

(60) Provisional application No. 60/989,699, filed on Nov. 21, 2007.

(51) Int. Cl.
*A43C 11/12* (2006.01)

(52) U.S. Cl. ..... 36/50.1

(58) Field of Classification Search ..... 36/50.1, 36/50.5; 24/68 SK, 70 SK
See application file for complete search history.

(56) References Cited

U.S. PATENT DOCUMENTS

| | | | | |
|---|---|---|---|---|
| 4,546,521 | A * | 10/1985 | Ribarits | 36/50.1 |
| 4,691,454 | A * | 9/1987 | Ottieri | 36/50.5 |
| 5,791,021 | A | 8/1998 | James | |
| 6,347,436 | B1 * | 2/2002 | Barber et al. | 36/50.1 |
| 6,978,558 | B2 | 12/2005 | Grella et al. | |
| 2002/0083621 | A1 | 7/2002 | Durocher | |
| 2002/0100188 | A1 | 8/2002 | Jacques et al. | |

* cited by examiner

*Primary Examiner* — Ted Kavanaugh
(74) *Attorney, Agent, or Firm* — Kenyon & Kenyon LLP

(57) ABSTRACT

An article of footwear comprising a sliding eyelet apparatus comprising a flexible track comprising at least one groove and at least one track, and a lace carrier comprising a lever comprising at least one tooth to engage said groove, a spring; and a slider comprising a rail to engage said flexible track.

1 Claim, 11 Drawing Sheets

SLIDELET$_{TM}$

Placement on hiking type shoe

SLIDELET$_{TM}$

Patent Information
- Utility and Design features

This is a adjustment/tensioning device designed for use with either a lace, cord, or cable

-This component is designed to be used in multiple locations on shoe; and in varied orientations.

-Can be used individually, or grouped together on shoe upper to create a system.

Placement on athletic type shoe

SLIDELET$_{TM}$

Placement in underside of shoe

Heel area placement

ADJUSTABLE SLIDING EYELET FOR FOOTWEAR

CROSS-REFERENCE TO RELATED APPLICATIONS

The present application claims the benefit of U.S. Provisional Application Ser. No. 60/989,699, filed Nov. 21, 2007, entitled "ADJUSTABLE SLIDING EYELET FOOTWEAR", the disclosure of which is incorporated herein by reference in its entirety.

BACKGROUND OF THE INVENTION

A. Field of the Invention

The present invention is directed toward footwear. More particularly, the invention relates to an adjustable sliding eyelet for footwear and a method of manufacture of same. The design, configuration, and location of a sliding eyelet may vary significantly and still be within the scope of the present invention.

B. Description of the Related Art

The sport shoe industry is currently enjoying great success in the consumer environment. This explosion may be attributed to a trend of ever-increasing sophistication in the products. In recent years, running shoes have been customized to fit a great many number of activities (e.g., skiing, hiking, trail running, distance running, etc.), each requiring its own performance criteria. Design considerations also may vary based on upon such criteria as gender, durability, and aesthetics.

These variable considerations have led a large spectrum of performance highly-specialized footwear, wherein each specific design may be directed toward a specific situation. For instance, short distance runners may concentrate on comfort, whereas long distance runners may prioritize low weight and streamlined design. Similarly, competitive runners may have different performance criteria than recreational runners. In each case, using a shoe designed specifically for another purpose may have negative consequences on performance, and even the runner's health.

Referring to FIG. 1, a conventional shoe construction is shown. Boot 110 may includes an outsole 112, midsole 114, shank 116, and shell 118. Heel cushion 120 and forefoot cushion 122 may be disposed between an insole 124 and shell 118. An upper 126 also is provided, and optionally may include lacing 128. Preferably, shank 116 is disposed in a recess 114*a* in midsole 114, while cushions 120, 122 are disposed in recesses in insole 124.

In this exemplary embodiment, outsole 112 is formed of carbon rubber, while midsole 114 is formed of molded ethyl vinyl acetate foam. Shank 116 may be formed of thermoplastic polyurethane, while upper 126 may be formed of leather, fabric textiles, foam and other suitable insulation. The various polymer components may be coupled to each other with an adhesive or other bonding agent, while upper 126 may be coupled to shell 118, for example, using stitching proximate the lower edge of leather portion 130 of upper 126.

Skiing is a sport which may require different design considerations than that of trail running. For example, in skiing, it is beneficial to provide the skier as close a fit as possible between the ski boot and the foot of the skier. This secure fit allows the skier to better direct and distribute forces at play (e.g., gravity, the skier's weight etc.).

To secure such a fit, a boot fastener (e.g., laces) is often used. However, problems may arise with the inability of a boot fastener to properly secure the foot generally, and yet allow for micro-adjustments of the boot's fit where necessary.

For example, many ski boots are secured with a lace that is tied in a knot above the shin. In these cases, the fit of the boot is typically more secure near the shin than, for example, the midfoot. While the secure fit near the shin may be optimal to prevent shin and ankle injuries, the relatively looser fit near the midfoot may hamper performance. In sum, conventional fasteners typically offer only monolithic adjustment ("macro-adjustment") in that they do not allow for particularized, localized fitting adjustments.

DETAILED DESCRIPTION OF THE DRAWINGS

Figure 1:
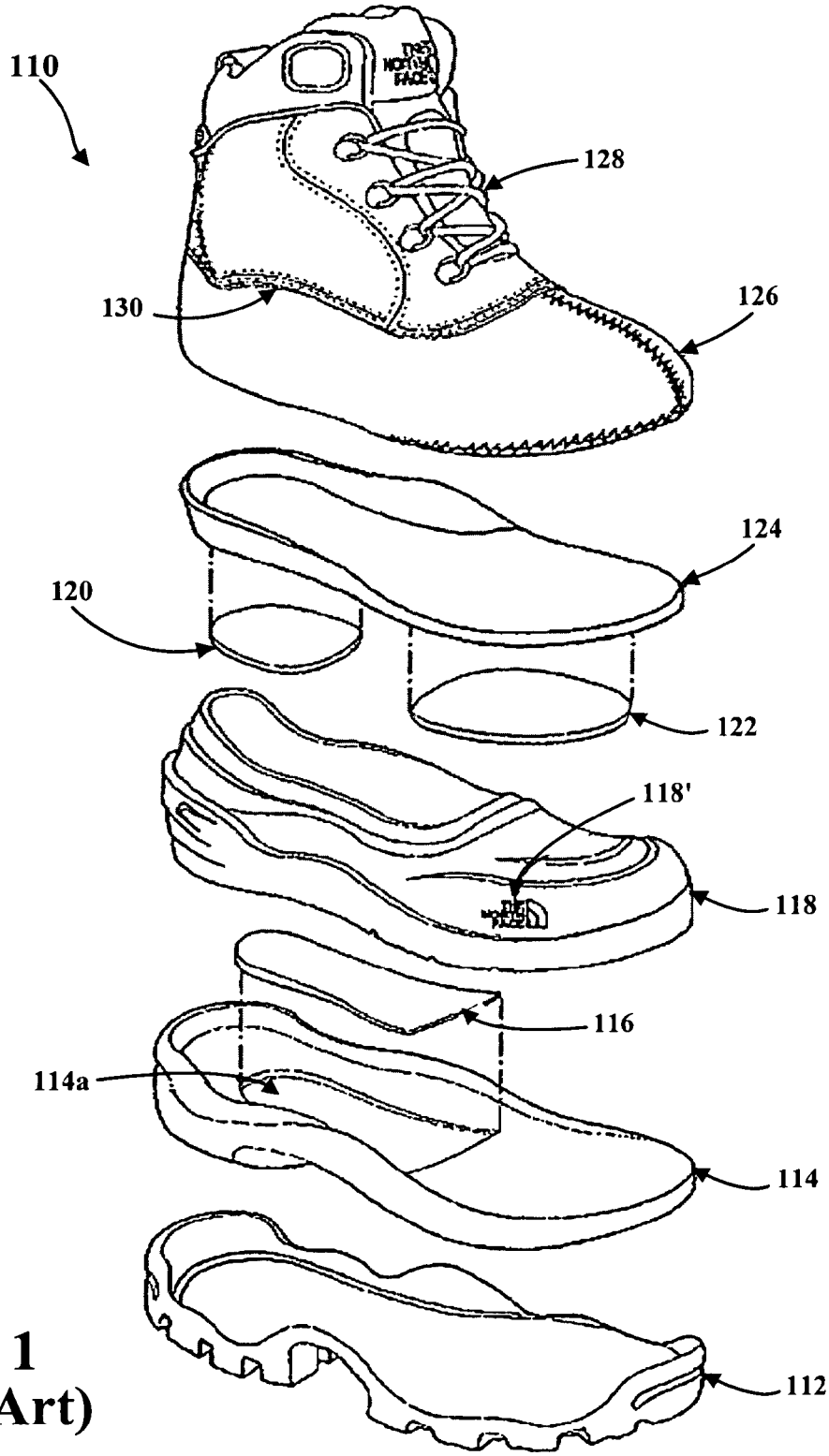
FIG. 1 (Prior Art)
FIG. 1 provides an illustration of an conventional shoe construction.

An adjustable sliding eyelet apparatus is provided. In embodiments of the present invention, the design may be uniquely optimized based on any number of criteria.

Detailed descriptions of one or more embodiments of the invention follow, examples of which may be graphically illustrated in the drawings. Each example and embodiment are provided by way of explanation of the invention, and not meant as a limitation of the invention. For example, features or described as part of one embodiment may be utilized with another embodiment to yield still a further embodiment. It is intended that the present invention include these and other modifications and variations.

Figure 2:
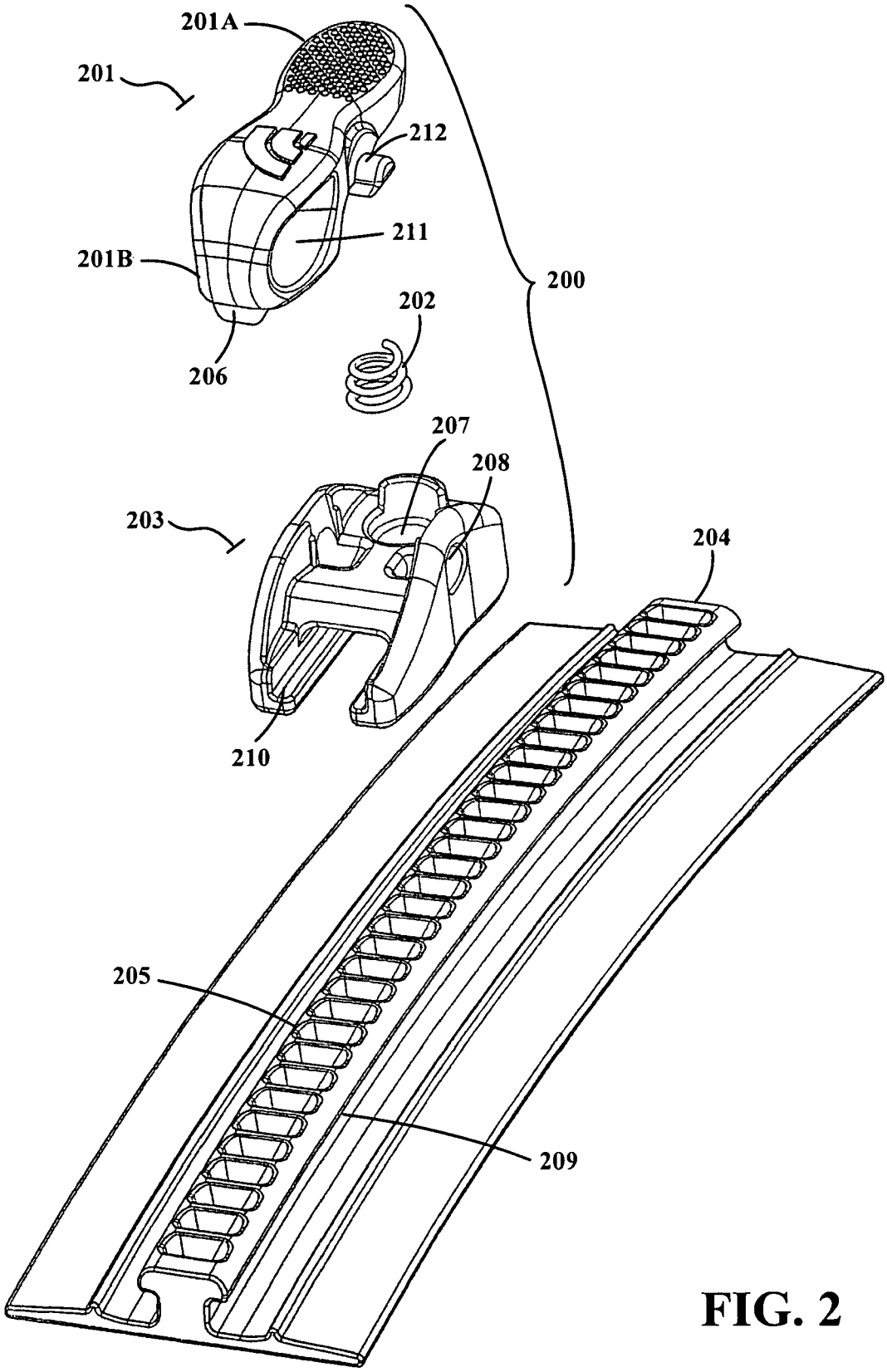
FIG. 2 provides an illustration of an exploded view of an exemplary adjustable sliding eyelet apparatus embodiment in accordance with the present invention.

FIG. 2 provides an exemplary illustration of an exploded view of an adjustable sliding eyelet apparatus embodiment in accordance with the present invention. In this embodiment, the sliding eyelet apparatus comprises lace carrier 200 and flexible track 204. Lace carrier 200 may comprise lever 201, spring 202, and slider 203. In this embodiment, lever 201 may be a "rocker" type of lever, in that it may be positioned to "rock" around a generally centralized fulcrum point. Lever 201 comprises tooth 206 to engage, for example, a molded track. In other embodiments of the present invention, lever 201 may comprise more than one tooth. In this embodiment, lever 201 further comprises an opening 211 on both sides through which, for example, a lace may be inserted.

Slider 203 may be molded to slide or move along a track, and may be made of a high-strength material, such as high-strength plastic (e.g., nylon, ABS). In this embodiment, slider 203 comprises cavity 207, opening 208, and rails 210.

Spring 203 may be a high strength spring and, in certain embodiments of the present invention, may be mounted on the topside of the slider 203 in cavity 207.

Flexible track 204 may comprise grooves 205. Grooves 205 may be employed to engage, for example, tooth 206 of lever 201. In certain embodiments according to the present invention, grooves 205 may be molded into the top surface (e.g., as shown in FIG. 1) of flexible track 204. In other embodiments, grooves 205 may be molded into the side or bottom surface of the flexible track 204.

Flexible track 204 may further comprise tracks 209 to engage the rails 210 of the slider 203. Rails 210 may be configured to slide along tracks 209. In this embodiment, the tracks 210 are located on both sides toward the bottom of the flexible track 204. The rails 210 engage the flexible track generally along the vertical walls of the flexible track 204. In other embodiments, tracks 210 may be vertical walls located toward the upper surface of the flexible track 204, or may primarily engage the rails 210 of slider 203 along the bottom horizontal surface of the flexible track 204.

Flexible track 204 may be made of, for example, a synthetic material (e.g., TPU, Hytrel).

Flexible track 204 is typically attached to the shoe through an attachment mechanism. For example, in certain embodiments of the present invention, the flexible molded track may be attached to the shoe upper by a stitch flange.

In the embodiment described in FIG. 2, spring 202 may be mounted in cavity 207 on topside of slider 203. Rear end 201A of lever 201 may then be mounted to spring 202. Lever 201 may also be mounted to slider 203, which acts as a fulcrum during "rocking". In certain embodiments, lever 201 may be mounted via posts 212. Spring 202 engages rear end of lever 201 to elevate with respect to front end 201B of lever 201. In so doing, tooth 206 engages groove 205 of flexible molded track 204 and "locks" in. To disengage, downward force applied to the top of rear end 201A of lever 201 serves to elevate front end 201B of lever 201, thereby disengaging tooth 206 from groove 205 of flexible track 204. If a lace has been inserted through opening 208, slider 203 may move along flexible track 204 to either tighten or loosen the fit of the shoe.

Figure 3:
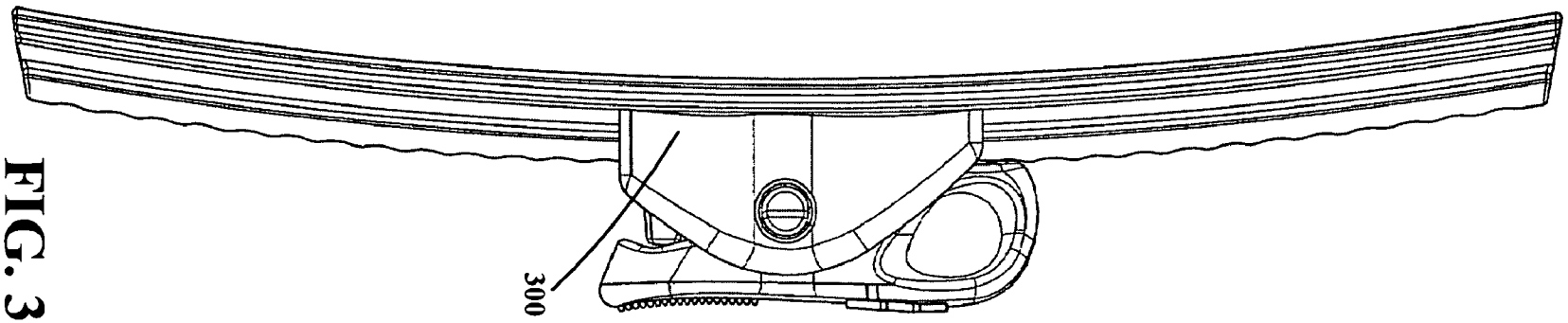
FIG. 3 provides an illustration of a side view of an exemplary adjustable sliding eyelet apparatus embodiment in accordance with the present invention.
Figure 4:
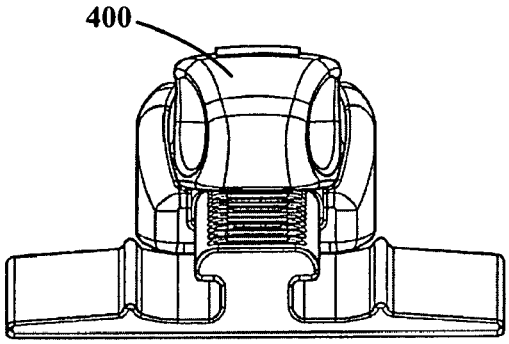
FIG. 4 provides an illustration of a front view of an exemplary adjustable sliding eyelet apparatus embodiment in accordance with the present invention.
Figure 5:
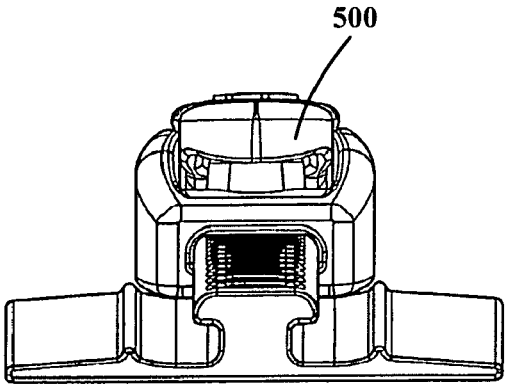
FIG. 5 provides an illustration of a back view of an exemplary adjustable sliding eyelet apparatus embodiment in accordance with the present invention.
Figure 6:
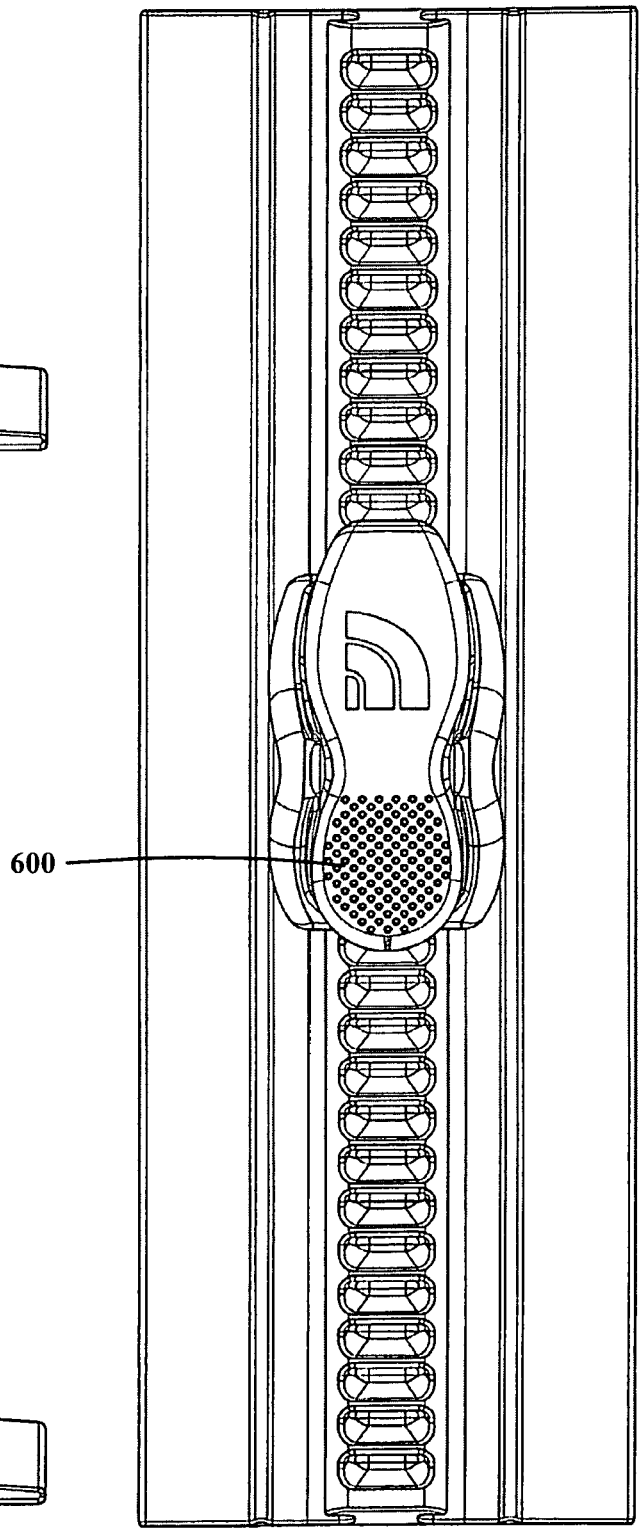
FIG. 6 provides an illustration of a top view of an exemplary adjustable sliding eyelet apparatus embodiment in accordance with the present invention.
Figure 7:
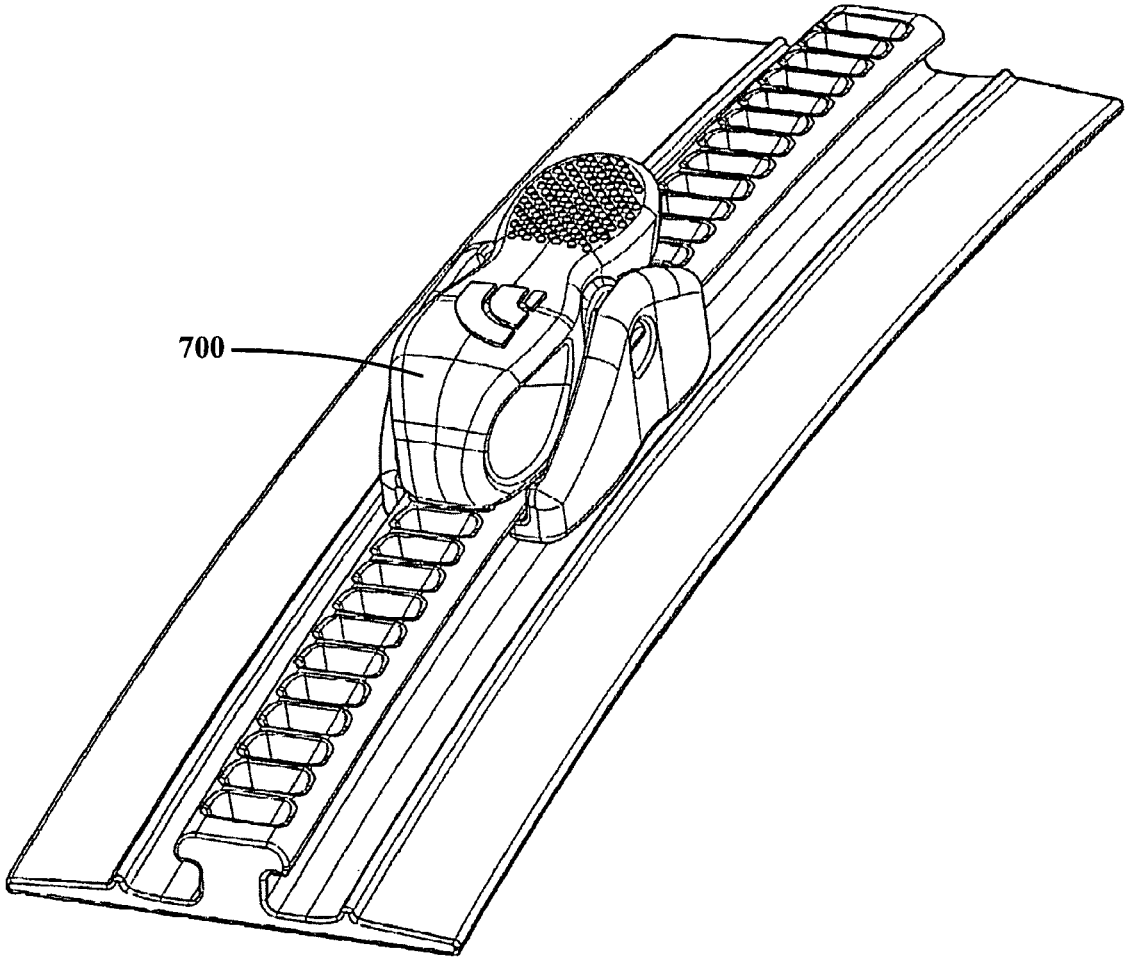
FIG. 7 provides an illustration of a perspective view of an exemplary adjustable sliding eyelet apparatus embodiment in accordance with the present invention.
Figure 8:
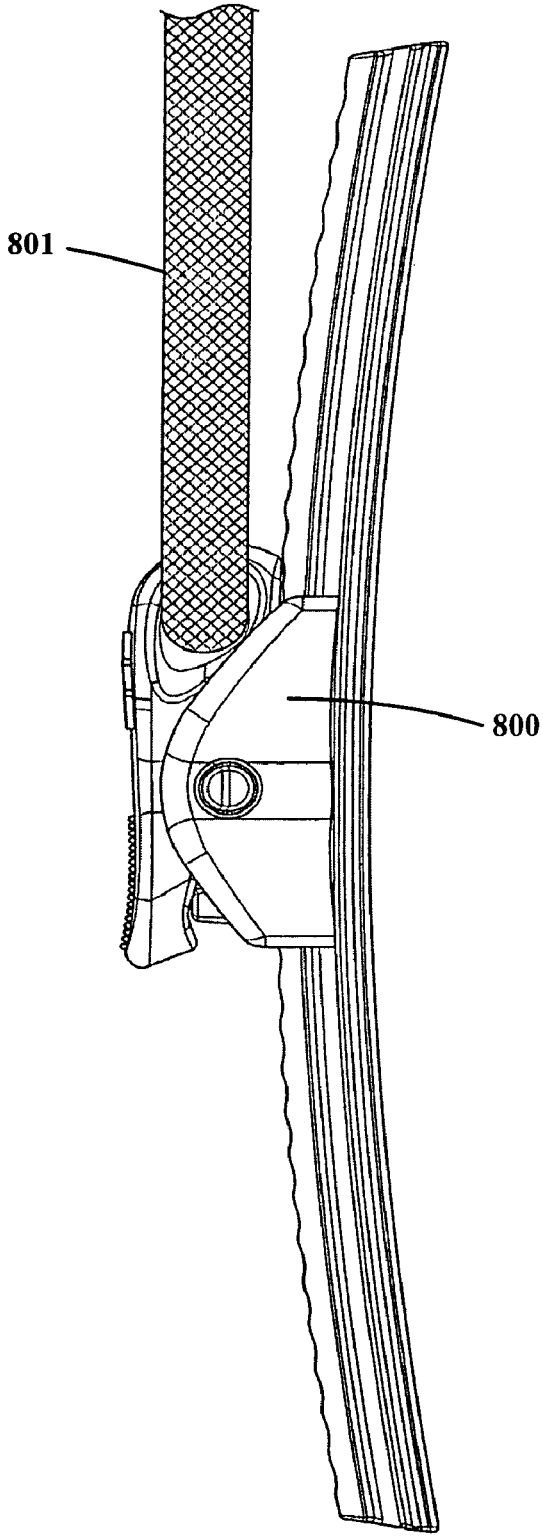
FIG. 8 provides an illustration of a side view of an exemplary adjustable sliding eyelet apparatus embodiment in accordance with the present invention.

FIG. 3 provides an exemplary illustration of a side view of an adjustable sliding eyelet apparatus embodiment 300 in accordance with the present invention. FIG. 4 provides an exemplary illustration of a front view of an adjustable sliding eyelet apparatus embodiment 400 in accordance with the present invention. FIG. 5 provides an exemplary illustration of a back view of an adjustable sliding eyelet apparatus embodiment 500 in accordance with the present invention. FIG. 6 provides an exemplary illustration of a top view of an adjustable sliding eyelet apparatus embodiment 600 in accordance with the present invention. FIG. 7 provides an exemplary illustration of a perspective view of an adjustable sliding eyelet apparatus embodiment 700 in accordance with the present invention. FIG. 8 provides an exemplary illustration of a side view of an adjustable sliding eyelet apparatus embodiment 800 having a shoelace 801 inserted in accordance with the present invention.

Figure 9:
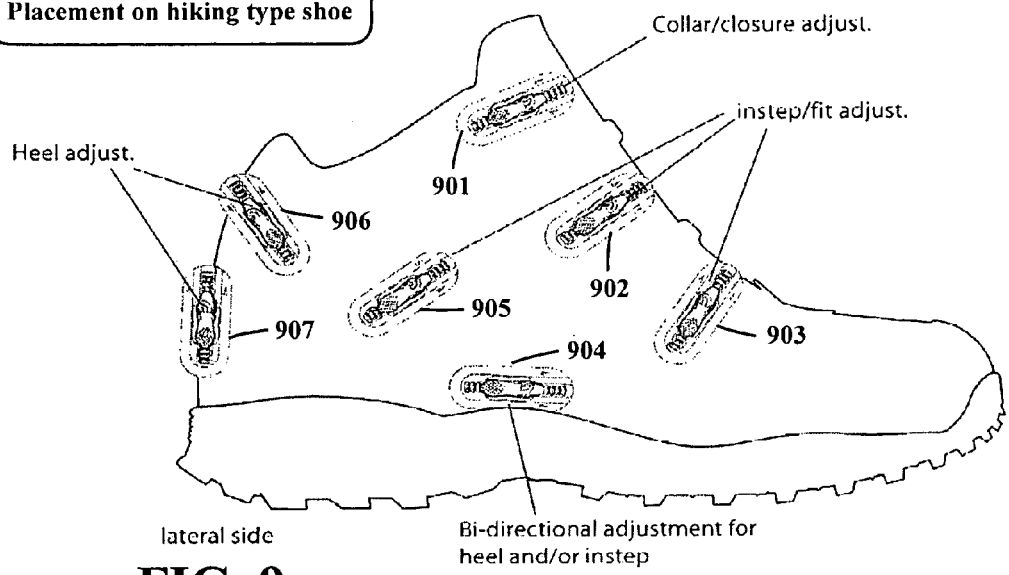
FIG. 9 illustrates exemplary placement locations of a number of sliding eyelet apparatus embodiments on the lateral side of a hiking shoe.

FIG. 9 illustrates exemplary placement locations of a number of sliding eyelet apparatus embodiments on the lateral side of a hiking shoe. Sliding eyelet apparatus 901 may be located near the upper to secure the high ankle and facilitate closure. Sliding eyelet apparatus 902 and sliding eyelet apparatus 903 may be located near the instep to facilitate adjustments in the midfoot area. Sliding eyelet apparatus 904 may be located near the lower portion of instep/above the insole to facilitate adjustments in the lower portions of the foot. Sliding eyelet apparatus 905 may be located near the ankle to secure the ankle area. Sliding eyelet apparatus 906 and 907 may be located near the upper and lower portions, respectively, of the heel portion to facilitate adjustments in the heel area.

Figure 10:
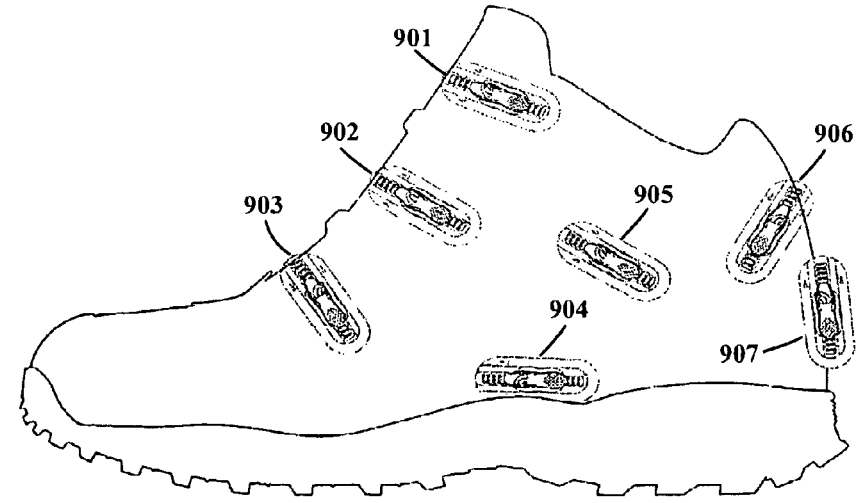
FIG. 10 illustrates exemplary placement locations of a number of sliding eyelet apparatus embodiments on the medial side of a hiking shoe.

FIG. 10 illustrates the locations of a number of sliding eyelet apparatus embodiments on the medial side of a hiking shoe.

Figure 11:
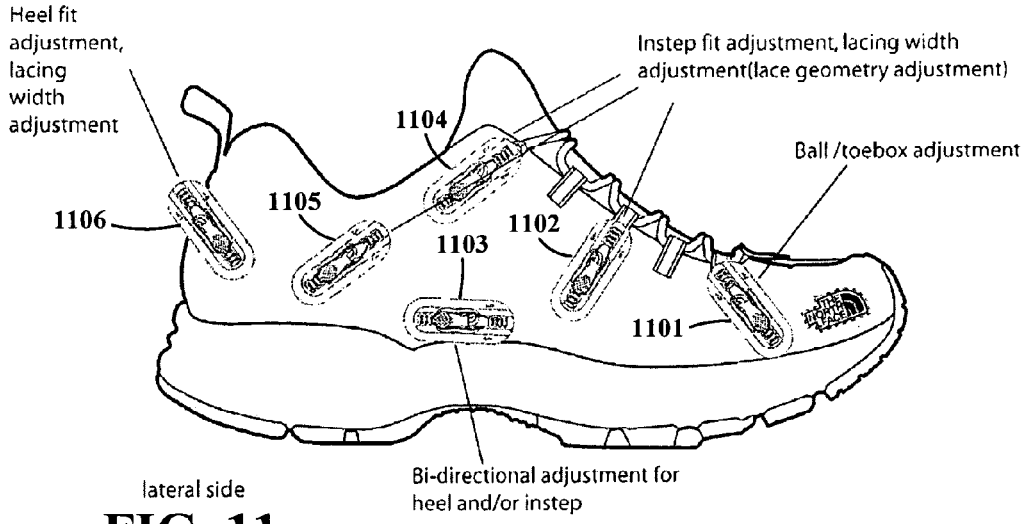
FIG. 11 illustrates exemplary placement locations of a number of sliding eyelet apparatus embodiments on the lateral side of an athletic shoe.

FIG. 11 illustrates exemplary placement locations of a number of sliding eyelet apparatus embodiments on the lateral side of an athletic shoe. Sliding eyelet apparatus 1101 may be located near the tip of the shoe to facilitate adjustment in the toe area. Sliding eyelet apparatus 1102 may be located near the instep to facilitate adjustments in the midfoot area. Sliding eyelet apparatus 1103 may be located near the lower portion of instep/above the insole to facilitate adjustments in the lower portions of the foot. Sliding eyelet apparatus 1104 may be located near the upper to secure the high ankle and facilitate closure. Sliding eyelet apparatus 1105 may be located near the ankle to secure the ankle area. Sliding eyelet apparatus 1106 may be located near the heel portion to facilitate adjustments in the heel area.

Figure 12:
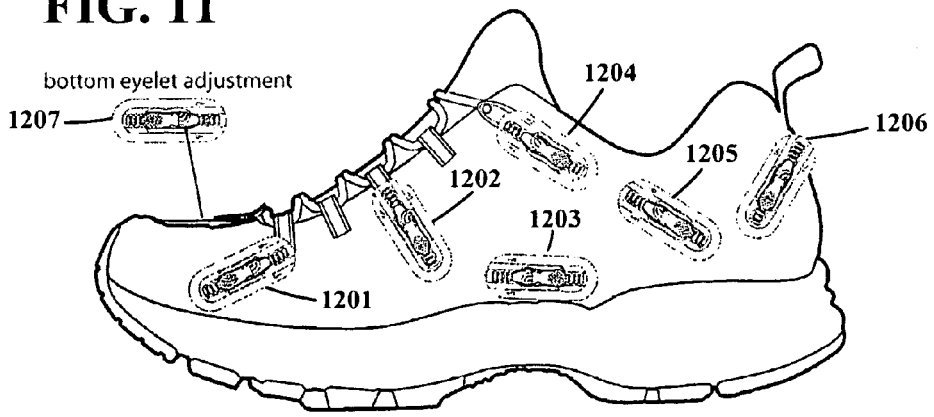
FIG. 12 illustrates exemplary placement locations of a number of sliding eyelet apparatus embodiments on the medial side of an athletic shoe.

FIG. 12 illustrates the locations of a number of sliding eyelet apparatus embodiments on the medial side of an athletic shoe.

Figure 13:
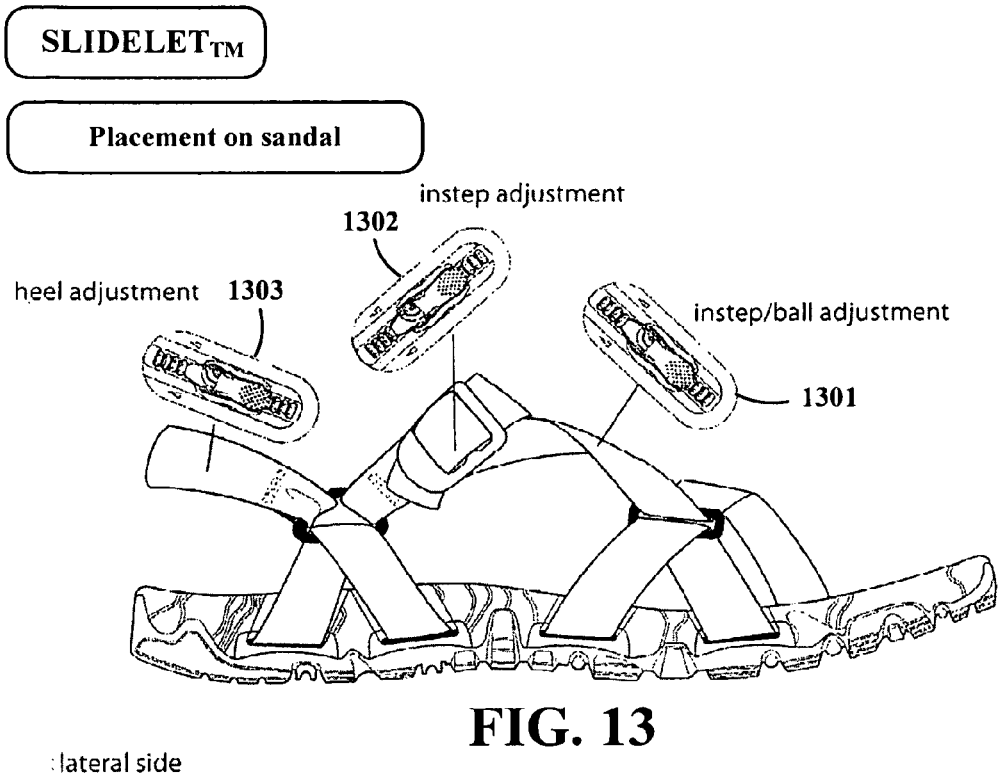
FIG. 13 illustrates exemplary placement locations of a number of sliding eyelet apparatus embodiments on the lateral side of a sandal.

FIG. 13 illustrates the locations of a number of sliding eyelet apparatus embodiments on the lateral side of a sandal. Sliding eyelet apparatus 1301 may be located near the instep to facilitate adjustments in the midfoot area. Sliding eyelet apparatus 1302 may be located near the instep to facilitate adjustments in the instep area. Sliding eyelet apparatus 1303 may be located near the heel to facilitate adjustments in the heel area.

Figure 14:
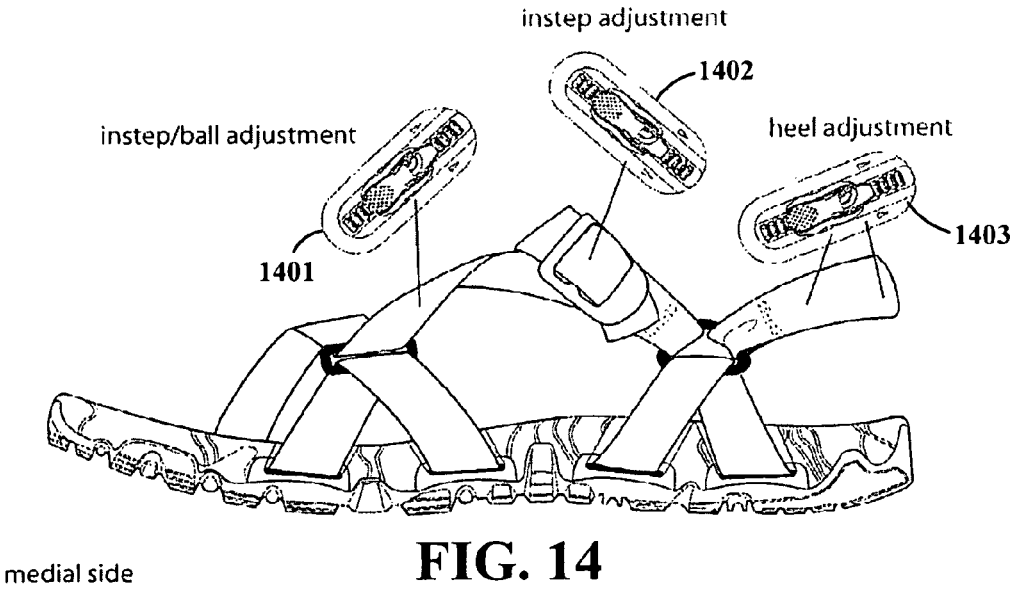
FIG. 14 illustrates exemplary placement locations of a number of sliding eyelet apparatus embodiments on the medial side of a sandal.

FIG. 14 illustrates the locations of a number of sliding eyelet apparatus embodiments on the medial side of a sandal.

Figure 15:
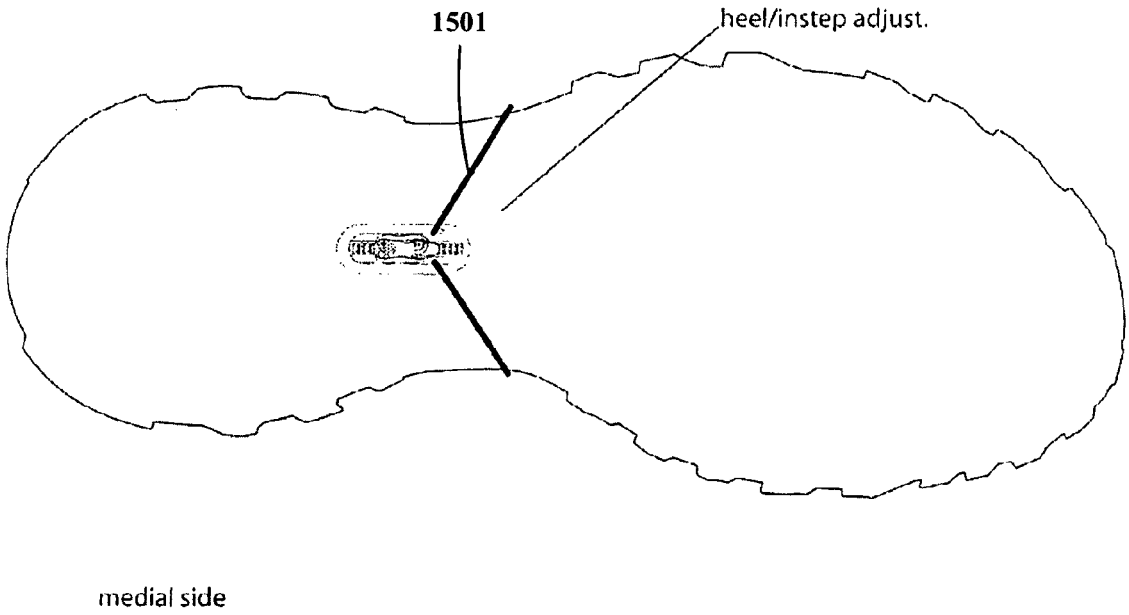
FIG. 15 illustrates exemplary placement locations of a number of sliding eyelet apparatus embodiments on an underside of a shoe.
Figure 16:
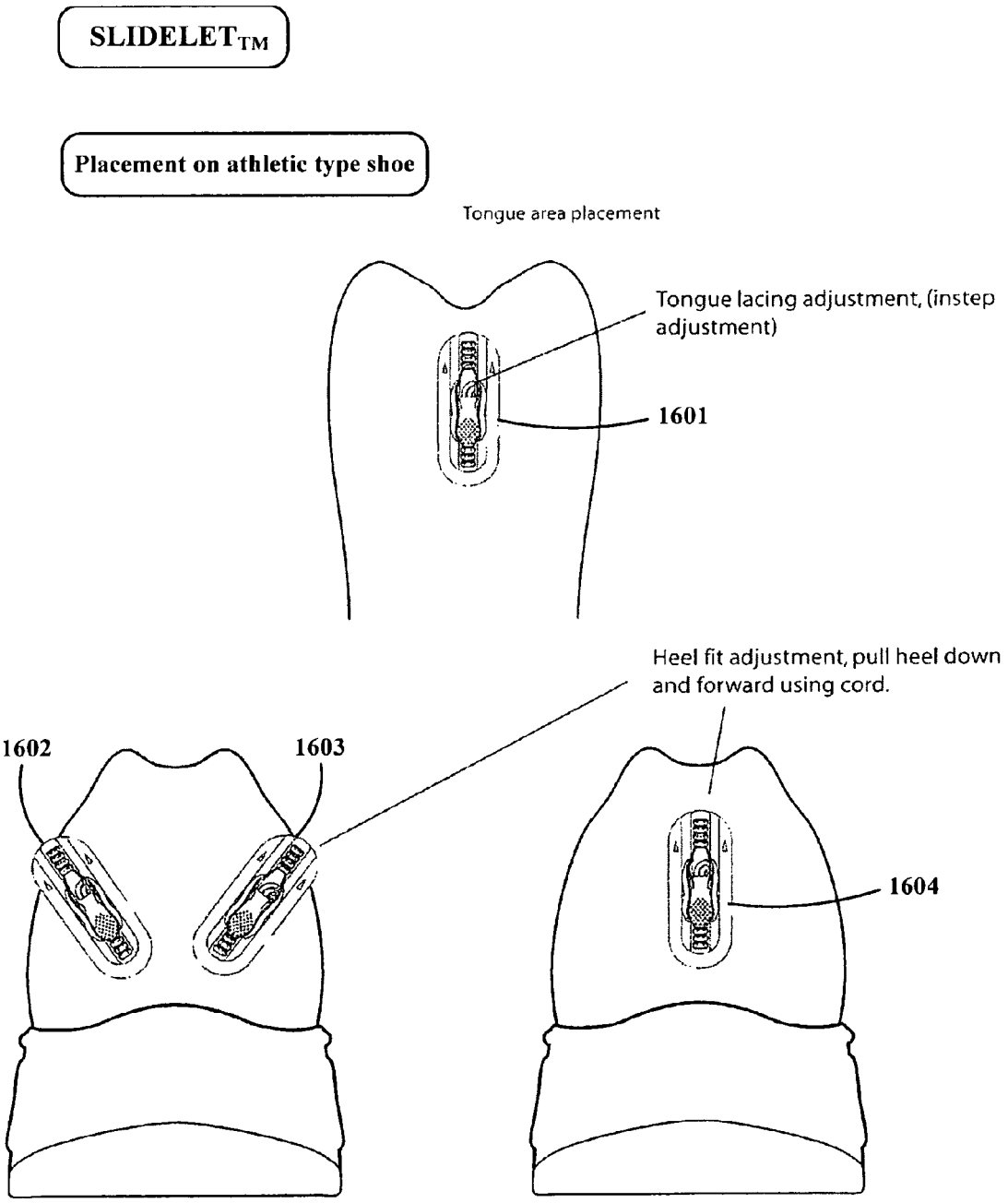
FIG. 16 illustrates exemplary placement locations of a number of sliding eyelet apparatus embodiments on a heel of a shoe and components of a shoe.

The configurations depicted in FIGS. 9-14 are not intended to exclude other possibilities. Those of skill in the art will appreciate that the foregoing systems and methods are susceptible of various modifications and alterations. For example, as shown in FIG. 15, a sliding eyelet apparatus 1501 may be located on the bottom of the outsole of a shoe (e.g., a hiking shoe, sandal) to adjust the heel and instep area. Similarly, in FIG. 16, sliding eyelet apparatus 1601 may be located on the tongue of a shoe (e.g., an athletic shoe) to facilitate adjustments in the instep area. Also, sliding eyelet apparatus 1602 and 1603 may be located on symmetrically opposite sides of the heel portion in an inclined fashion to facilitate adjustments in the heel area. Alternatively or in addition, sliding eyelet apparatus 1604 may be located along the central axis of the heel portion of the shoe to facilitate adjustments in the heel as well.

While the present invention has been described with reference to the aforementioned applications, this description of the preferred embodiments is not meant to be construed in a limiting sense. It shall be understood that all aspects of the present invention are not limited to the specific depictions, configurations or dimensions set forth herein which depend upon a variety of principles and variables. Various modifications in form and detail of the disclosed apparatus, as well as other variations of the present invention, will be apparent to a person skilled in the art upon reference to the present disclosure. It is therefore contemplated that the appended claims shall cover any such modifications or variations of the described embodiments as falling within the true spirit and scope of the present invention.

What is claimed is:

1. An article of footwear comprising:

a sliding eyelet apparatus comprising:

a flexible track comprising:

a groove and a track; and a lace carrier comprising:

a lever comprising a tooth to engage said groove;

a spring; and a slider comprising a rail to engage said track.

* * * * *